US006922872B2

(12) United States Patent
Gruber

(10) Patent No.: US 6,922,872 B2
(45) Date of Patent: Aug. 2, 2005

(54) AUTOMOTIVE DOOR HINGE WITH STRUCTURALLY INTEGRATED PIVOT

(75) Inventor: Rudolf Gruber, Uxbridge (CA)

(73) Assignee: Multimatic, Inc., Markham (CA)

( * ) Notice: Subject to any disclaimer, the term of this patent is extended or adjusted under 35 U.S.C. 154(b) by 0 days.

(21) Appl. No.: 10/416,584

(22) PCT Filed: Jul. 30, 2002

(86) PCT No.: PCT/CA02/01193

§ 371 (c)(1),
(2), (4) Date: May 13, 2003

(87) PCT Pub. No.: WO03/012234

PCT Pub. Date: Feb. 13, 2003

(65) Prior Publication Data

US 2004/0025294 A1 Feb. 12, 2004

Related U.S. Application Data

(60) Provisional application No. 60/316,017, filed on Aug. 31, 2001.

(30) Foreign Application Priority Data

Aug. 2, 2001 (CA) ..... 2354796

(51) Int. Cl.[7] ..... E05D 7/10; E05D 5/10

(52) U.S. Cl. ..... 16/260; 16/222; 16/224; 16/273; 16/386

(58) Field of Search ..... 16/224, 222, 254, 16/260–264, 272, 273, 386

(56) References Cited

U.S. PATENT DOCUMENTS

| | | | | | |
|---|---|---|---|---|---|
| 90,330 | A | * | 5/1869 | Walters | 16/386 |
| 3,135,013 | A | | 6/1964 | Parsons | |
| 3,349,427 | A | * | 10/1967 | Cairns et al. | 16/273 |
| 4,137,603 | A | * | 2/1979 | Kvasnes | 16/381 |
| 4,491,436 | A | * | 1/1985 | Easton | 403/122 |
| 4,854,009 | A | * | 8/1989 | Brockhaus | 16/263 |
| 4,864,689 | A | | 9/1989 | Brockhaus | |
| 5,249,334 | A | * | 10/1993 | Horberg et al. | 16/224 |
| 6,427,287 | B1 | * | 8/2002 | Brueckner et al. | 16/342 |

FOREIGN PATENT DOCUMENTS

| | | | | |
|---|---|---|---|---|
| DE | 291796 | | 9/1919 | |
| DE | 3404152 | A1 * | 8/1985 | E05F/3/20 |
| DE | 3405082 | A1 * | 8/1985 | E05D/7/10 |
| EP | 512258 | A1 * | 11/1992 | E05D/5/12 |
| EP | 0613988 | | 3/1997 | |
| EP | 0777025 | | 6/1997 | |
| EP | 1043468 | A2 * | 10/2000 | E05D/5/12 |
| EP | 1378673 | A1 * | 1/2004 | F16C/11/04 |
| FR | 1421451 | | 11/1965 | |
| GB | 291796 | | 10/1928 | |

* cited by examiner

*Primary Examiner*—Chuck Y. Mah
(74) *Attorney, Agent, or Firm*—Kramer & Amado, P.C.; Gordon J. Zimmerman, Esq.

(57) ABSTRACT

An automotive hinge comprises: a door component adapted to be mounted to a vehicular closing panel, the door component comprising a conical pivot axis aperture; a body component adapted to be mounted to a vehicular body structure, said body component comprising a pivot arm; the door component and the body component being adapted to rotate about a pivot axis; the body component comprising an upstanding, conical structural feature extending from the body component and adapted to be coaxially aligned with the pivot axis and structurally fixed to the pivot arm of the body component; the conical structural feature comprising an external conical bearing surface; such that when the hinge is assembled, the door component interleaves over the body component, dimensionally locating the door and body components by means of the walls of the conical pivot axis aperture of the door component interacting with the external conical bearing surface of the conical structural feature. In an alternative embodiment, the conical structural feature is located on the door component and the body component is adapted to receive it.

26 Claims, 8 Drawing Sheets

AUTOMOTIVE DOOR HINGE WITH STRUCTURALLY INTEGRATED PIVOT

This application claims the benefit of provisional 60/316,017 filed on Aug. 31, 2001.

FIELD OF THE INVENTION

This invention applies to hinges, more particularly to automotive door hinges, which facilitate motion of a closure panel relative to a fixed body structure, and simplify removal and reinstallation of the closure panel to and from the body structure during specific phases of the vehicle assembly operation.

DESCRIPTION OF THE PRIOR ART

Automotive door hinges are generally configured to include a door component that is rigidly attached to a closure panel and a body component that is rigidly attached to a body structure. This structural attachment of the components can be achieved by welding, riveting, bolting or similar mechanical fastening means. The simple rotary motion of the door component relative to the body component is normally achieved by a pivot pin and associated bearing surfaces. The pivot pin is configured to be rigidly attached to one of the hinge components while the other component freely rotates around the pivot pin via one or more bearing surfaces. It is normal practice to utilize two of these hinge assemblies, vertically offset with coaxially aligned pivot pins, to attach a closure panel to a body structure.

In many modern automotive vehicle assembly plants the closure panel is removed from the body structure after the vehicle has been initially assembled and painted. This post paint detachment of the closure panel is undertaken to facilitate ease of final assembly of the vehicle interior which includes installing large components such as the instrument panel, seats, carpet and headliner as well as simplifying the final assembly of the door hardware components such as the latch and window lift mechanism. An important aspect of the closure panel's removal and reinstallation process is that it is normal practice to set the final door position during the vehicle's initial assembly, prior to painting. In this way the gap margins and surface flushness, which are among the most important aspects of vehicle quality, are set during the initial structural framing and can be evaluated before and just after painting. This generally accepted approach requires that the method utilized to remove and reinstall the closure panel after painting, during the final assembly process, must facilitate exact replication of the original door position. There is a wide range of prior art that facilitates the removal and reinstallation of vehicle closure panels while maintaining the dimensional integrity of the original installation process.

A common embodiment of a removable door hinge system utilizes a cantilevered pivot pin to facilitate the door component being simply interleaved over the body component of the hinge. The body component incorporates a suitably sized hole containing a pivot bushing through which the pivot pin is riveted creating a structural joint with rotational freedom. A portion of the pivot pin is configured with a conical feature that interacts with a conical feature in the pivot axis hole of the door component. When the conical feature in the pivot axis hole of the door component is placed over the conical aspect of the pivot pin, a rotational locking action is created. A clip, nut or similar mechanical device retains the door component on the pivot pin and all structural loading is transferred via the portion of the pivot pin comprising the conical feature. Relative rotation of the door component and body component is facilitated via the non-conical aspect of the pivot pin rotating inside the body component's bushing. This cantilevered pivot pin arrangement is referred to as single hung and transmits all imparted bending moments directly to the pivot pin.

The above-described, single hung cantilevered pivot pin arrangement assures ease of removal and accurate reinstallation of the closure panel but is structurally inferior to a fully riveted, double hung hinge configuration. A conventional double hung hinge converts imparted bending moments into structurally preferable force couples. To counteract the significant imparted moment associated with a single hung hinge, a robust, complex joint must be made between the hinge component and the separate pivot pin. Additionally, to assure ease of reinstallation, adequate vertical load carrying capability and good final retention, a complex pin configuration is required.

Accordingly, it would be advantageous to create a single hung hinge assembly in which the pivot is wrought from, integral with or rigidly fixed to the hinge component. In this way the imparted moment would act directly on the hinge component as the pivot would be structurally integrated in the hinge component. Additionally, it would be a significant improvement over the existing art if the pivot was configured to create both a conical interface and horizontal load carrying surface for the rotational joint. In this manner an accurate and easy reinstallation process would be assured while allowing the integrated pivot to be simply machined from the hinge component. Additionally, by providing a threaded hole in the end of the structural pivot an extremely strong finished joint would be assured through the utilization of a simple bolt.

SUMMARY OF THE INVENTION

In a principal aspect of the invention, an automotive hinge comprises: a door component adapted to be mounted to a vehicular closure panel, said door component comprising a conical pivot axis aperture; a body component adapted to be mounted to a vehicular body structure, said body component comprising a pivot arm; the door component and the body component being adapted to rotate about a pivot axis; an upstanding conical structural feature extending from the body component and adapted to be coaxially aligned with the pivot axis and structurally fixed to the pivot arm of the body component; such that when the hinge is assembled, the door component interleaves over the body component, dimensionally locating said components by means of the walls of the conical pivot axis aperture of the door component interacting with an external conical bearing surface on the conical structural feature.

In further aspects of the invention:

(a) the conical structural feature is wrought from the base material of the hinge body component;

(b) the conical structural feature is machined, forged or cast in the base material of the hinge body component;

(c) a rigid bushing is configured to fit over the conical structural feature to contact said conical bearing surface;

(d) the rigid bushing comprises a tapered internally facing surface which comprises a lubricating coating or film;

(e) said lubricating coating or film comprises the polymer PTFE;

(f) the rigid bushing comprises a split line adapted to permit reversible expansion of the dimensions of the bushing;

(g) the rigid bushing comprises an unlubricated externally facing surface to facilitate clamping of the bushing into the conical pivot axis aperture;

(h) the rigid bushing further comprises a base comprising a horizontal surface configured substantially perpendicular to a longitudinal axis of the bushing, the horizontal surface being adapted to carry vertical hinge loadings;

(i) the conical structural feature comprises a distal end and an outward step proximate said distal end, said step being configured to retain the rigid bushing;

(j) the body component and door component are retained in assembly by a bolt configured to thread coaxially into an internally threaded feature in the conical structural feature;

(k) the body component and door component are retained in assembly by a clip, nut, or other similar mechanical fastening means.

In an alternative embodiment, the invention comprises an automotive hinge comprising a body component adapted to be mounted to a vehicular body structure, said body component comprising a conical pivot axis aperture; a door component adapted to be mounted to a vehicular closure panel, said door component comprising a pivot arm; the door component and the body component being adapted to rotate about a pivot axis; the door component comprising a conical structural feature extending from the door component and adapted to be coaxially aligned with the pivot axis and structurally fixed to the pivot arm; the conical structural feature comprising an external conical bearing surface; such that when the hinge is assembled, the door component interleaves over the body component, dimensionally locating the door and body components by means of the walls of the conical pivot axis aperture of the body component interacting with the external conical bearing surface of the conical structural feature.

The further aspects of the invention set out above are also applicable to this alternative embodiment in which the positions of the conical pivot axis aperture and the conical structural feature are changed from either the door component or the body component, to the other of said components. Thus, in either of the main embodiments of the invention, either the conical structural feature will be lowered into the conical pivot axis aperture or the conical pivot axis aperture will be placed over an upstanding conical structural feature.

In the preferred embodiment, the bushing is interposed between the walls of the conical pivot axis aperture and the external conical bearing surface of the conical structural feature.

In a further alternative embodiment to either embodiment referred to above, the rigid bushing is configured to fit into the conical pivot axis aperture. The rigid bushing comprises a tapered externally facing surface which comprises a lubricating coating or film. The lubricating coating or film preferably comprises the polymer PTFE. The rigid bushing comprises a split line adapted to permit reversible contraction of the dimensions of the bushing. The rigid bushing comprises an unlubricated internally facing surface to facilitate clamping of the bushing onto the outer surface of the conical structural feature. The conical structural feature has a continuous tapered outer surface. The bushing may be retained in the conical pivot aperture by upsetting the bushing material to create a flange.

Further aspects of the invention will be apparent from the following description.

DETAILED DESCRIPTION OF THE INVENTION

Figure 1:
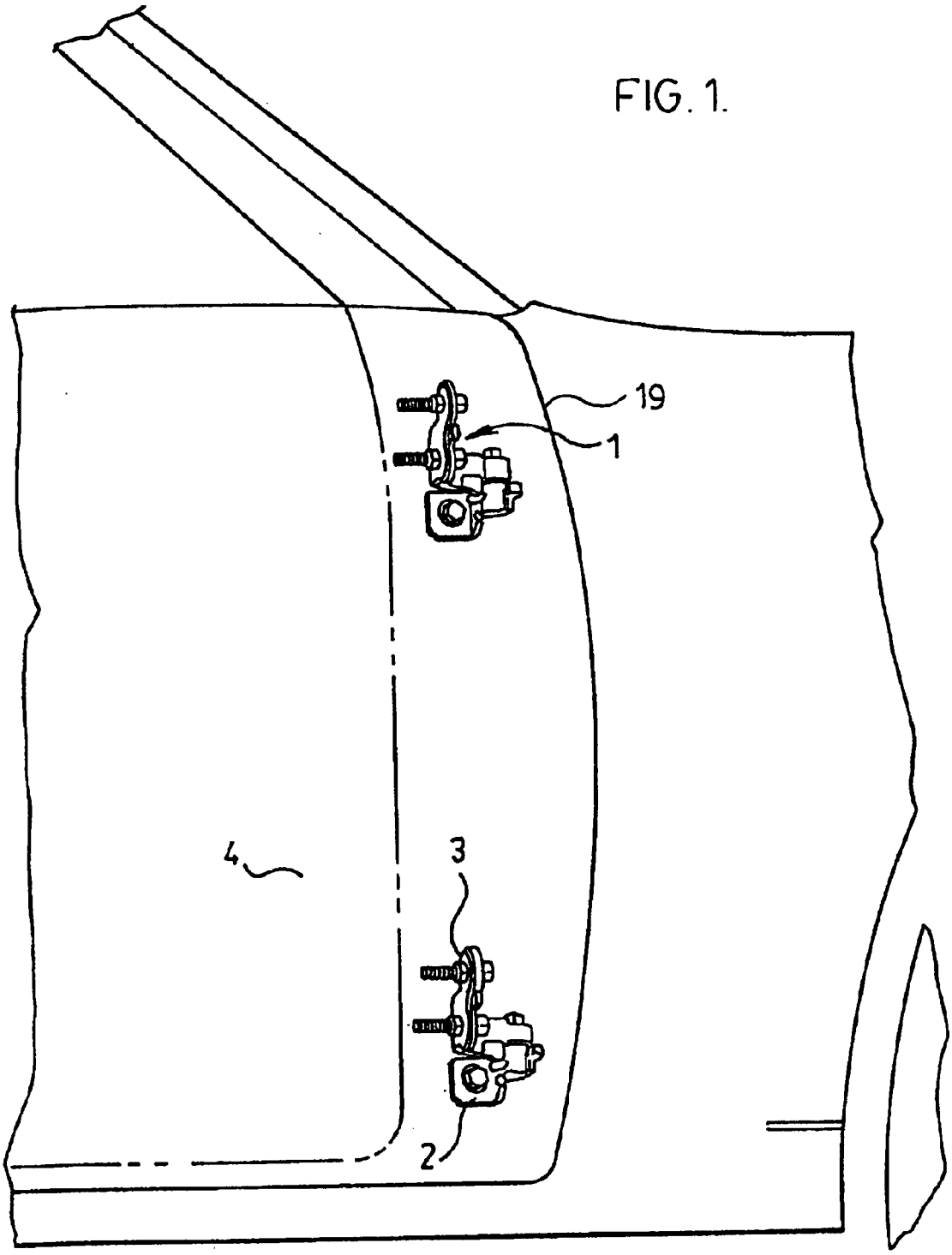
FIG. 1 is a side view of a pair of the inventive hinge assemblies in a typical automotive installation.
Figure 2:
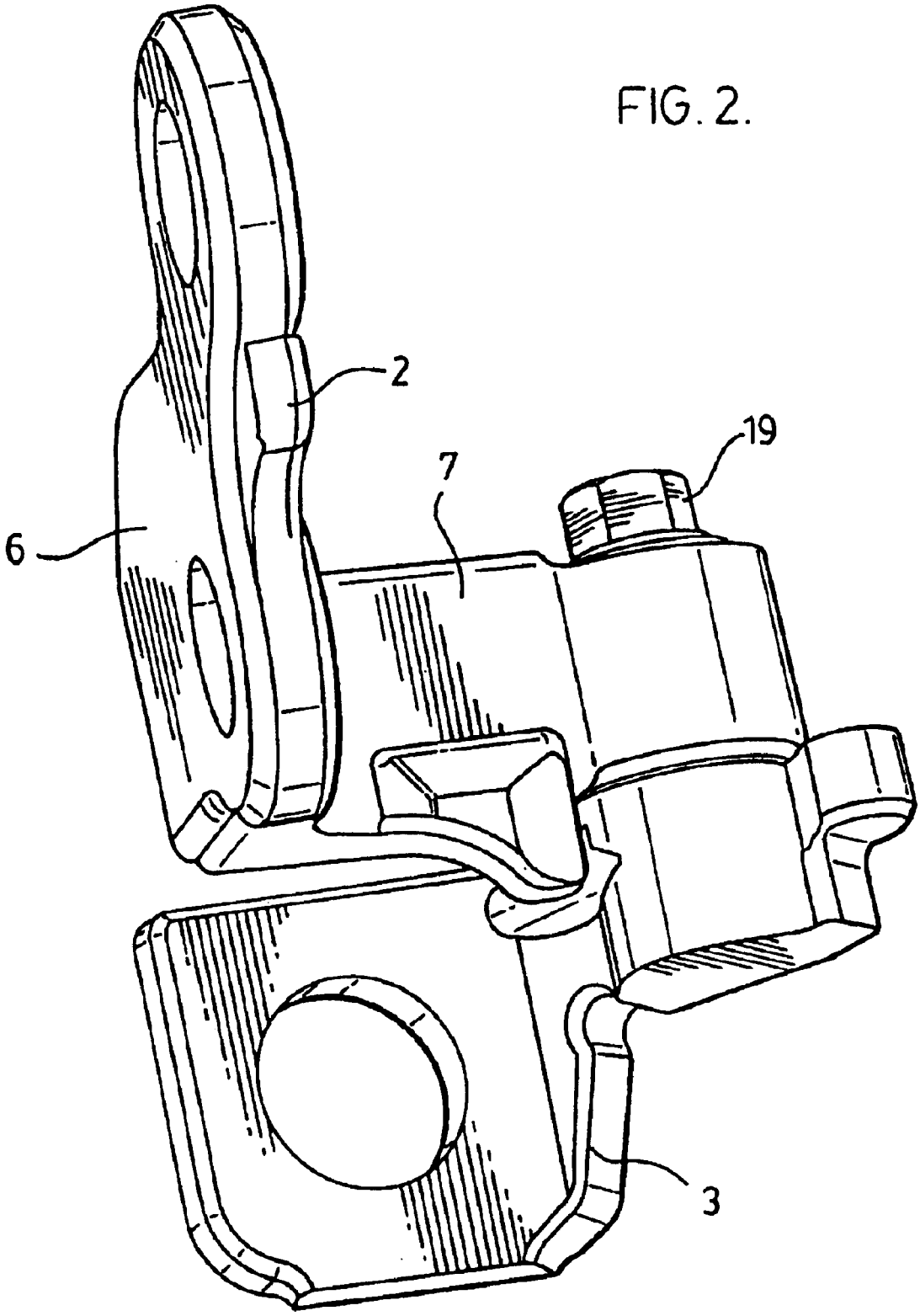
FIG. 2 is a perspective view of the inventive hinge assembly in a fully assembled state.
Figure 3:
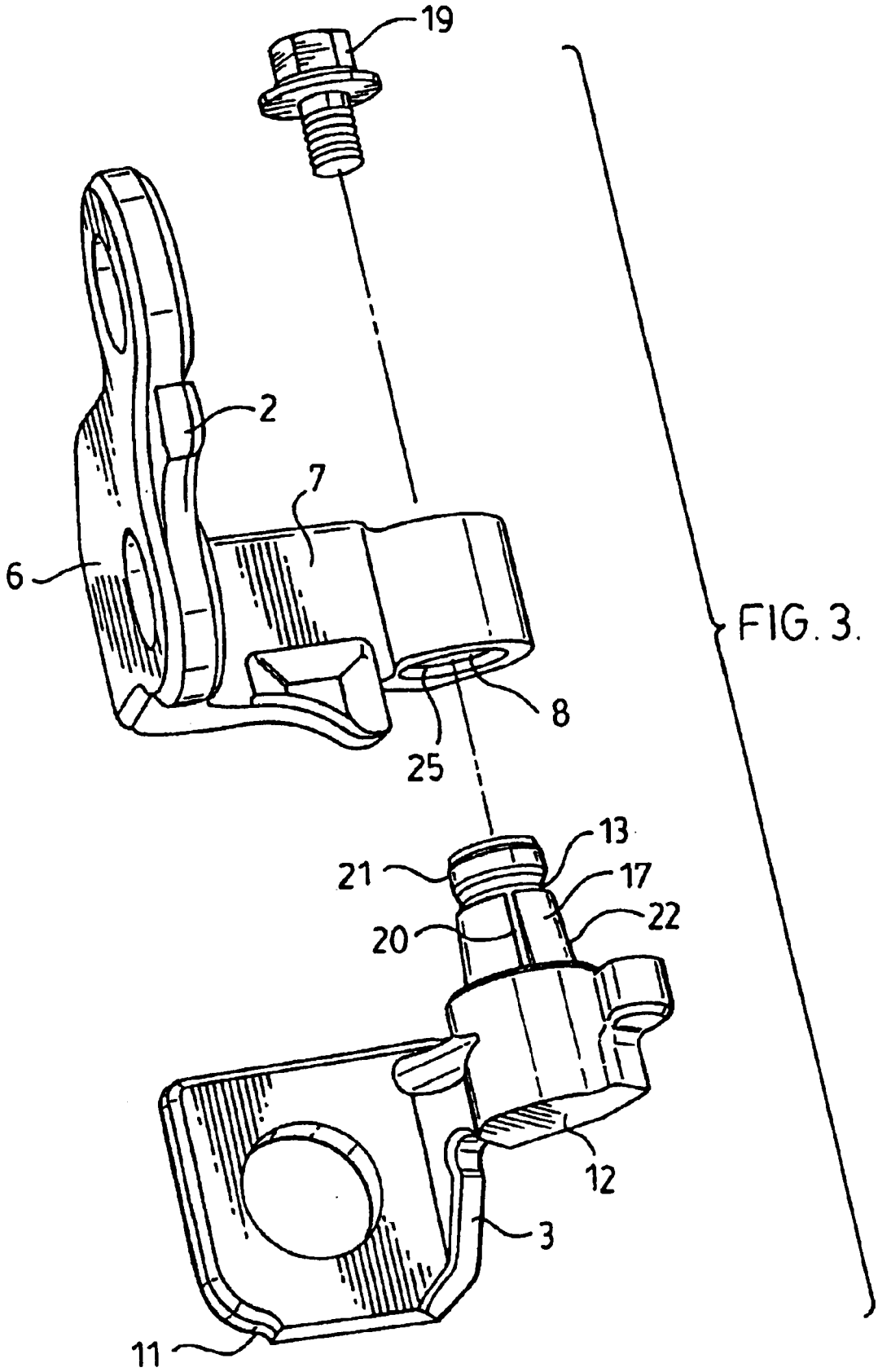
FIG. 3 is an exploded perspective view of the components of the inventive hinge assembly.
Figure 4:
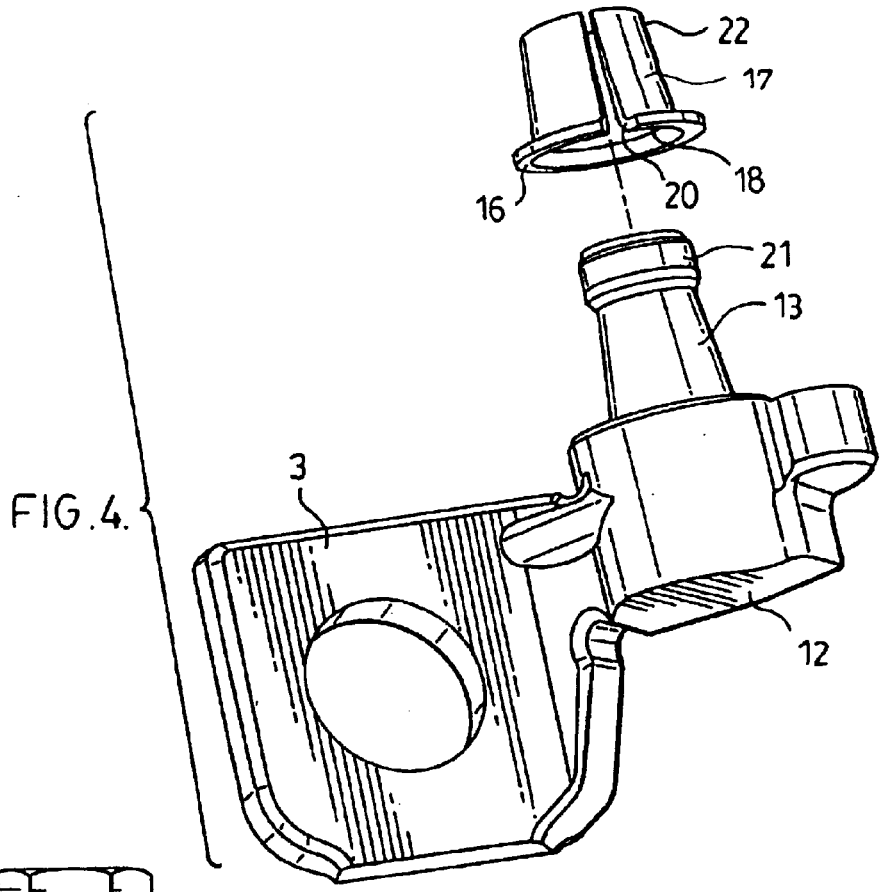
FIG. 4 is an exploded perspective view of the body component of the inventive hinge assembly.
Figure 5:
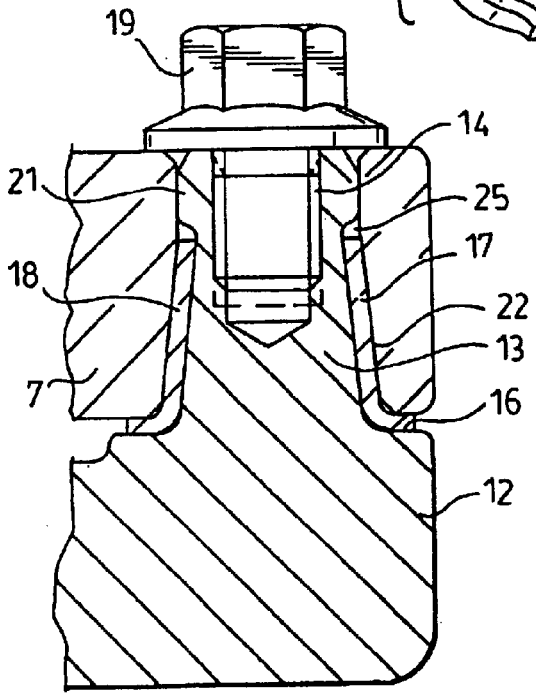
FIG. 5 is a partial sectional view of the inventive hinge assembly through the centreline of the conical, structural feature.

Referring to FIGS. 1, 2 and 3, a door hinge assembly (1) is substantially constructed from a door component (2) and a body component (3). The door component is configured with a door component mounting surface (6) and a door component pivot arm (7). The door component pivot arm contains a conical pivot axis aperture (8) with walls (25). The door component is structurally attached to a closure panel (4) via its door component mounting surface (6) using bolting, welding, bonding, riveting or similar fastening means. Referring to FIGS. 3 and 4, the body component (3) is configured with a body component mounting surface (11) and a body component pivot arm (12). The body component pivot arm is configured with an upstanding conical structural feature (13) that contains an internally threaded feature (14) coaxial with its outer surface, as illustrated in FIG. 5. The body component (3) is structurally attached to a body structure (19) via its body component mounting surface (11) using bolting, welding, bonding, riveting or similar fastening means.

Referring to FIGS. 3, 4 and 5, a rigid bushing (17) is internally coated with a lubricating film, such as the polymer PTFE, and is configured to fit over the conical structural feature (13) and provide a horizontal load bearing surface (16) against the hinge body component's pivot arm (12) and an internal tapered surface (18) configured to bear against the conical structural feature (13). Other lubricating films or coatings may also be employed to permit the internally facing tapered surface of the bushing to rotatingly slide over the outer surface of the conical structural feature. A split line (20) allows the bushing to be easily installed since it can open and expand to be fitted over the conical structural feature, and aids in rotationally locking the bushing into the conical pivot axis aperture (8) on the non-lubricated, external surface of the bushing when longitudinal or vertical retention force is applied. An outwardly stepped feature (21) at the outer or distal end of the conical structural feature is configured to retain the rigid bushing longitudinally.

The door component (2) interleaves over the body component (3) and dimensionally locates itself by means of the external, unlubricated tapered surface (22) of the rigid bushing (17) mating to the walls (25) of the conical pivot axis aperture (8) of the door component (2). The assembly is structurally completed to prevent the door component and body component from moving longitudinally relative to each other by a bolt (19) attached to the conical structural feature (13) via the internally threaded feature (14). Relative rotation of the two hinge components is facilitated by the conical structural feature (13) remaining free to rotate inside the rigid bushing (17), which in turn is rotationally locked into the conical pivot axis aperture (8) of the door component (2) by frictional contact between the non-lubricated external surface of the bushing (17) and the walls (25) of the aperture (8).

Structural loadings, such as those imparted by a crash, are transferred between the door component (2) and body component (3) via the conical structural feature (13) which is wrought from, and integral to, the body component. This significantly improves the single hung, cantilevered arrangement since it eliminates the requirement of a pin-to-hinge structure joint interface.

The removal of the closure panel following a painting operation is simply facilitated by unthreading the bolt (19) and lifting the closure panel's door components (2) off of the body component's rigid bushings (17). Removal efforts are substantially reduced due to the conical configuration of the rigid bushing, which facilitates rotational locking while maintaining longitudinal freedom of movement. When the closure panel is reinstalled on the vehicle, the upper and lower hinges' door components are aligned with the corresponding body components by placing the conical pivot axis aperture (8) over the rigid bushings (17). The assemblies are then structurally completed by threading the fastening bolts (19) into the internally threaded features (14) of the conical structural features (13) and applying a suitable torque to the bolts. Each rigid bushing is thereby rotationally clamped into the corresponding conical pivot axis aperture; its conical walls ending at the horizontal load bearing surface (16), in the presence of a longitudinal clamping load and with flexure of the bushing about the split line (20), combine to create a locking action into the conical pivot axis aperture (8) of the door component.

Figure 6:
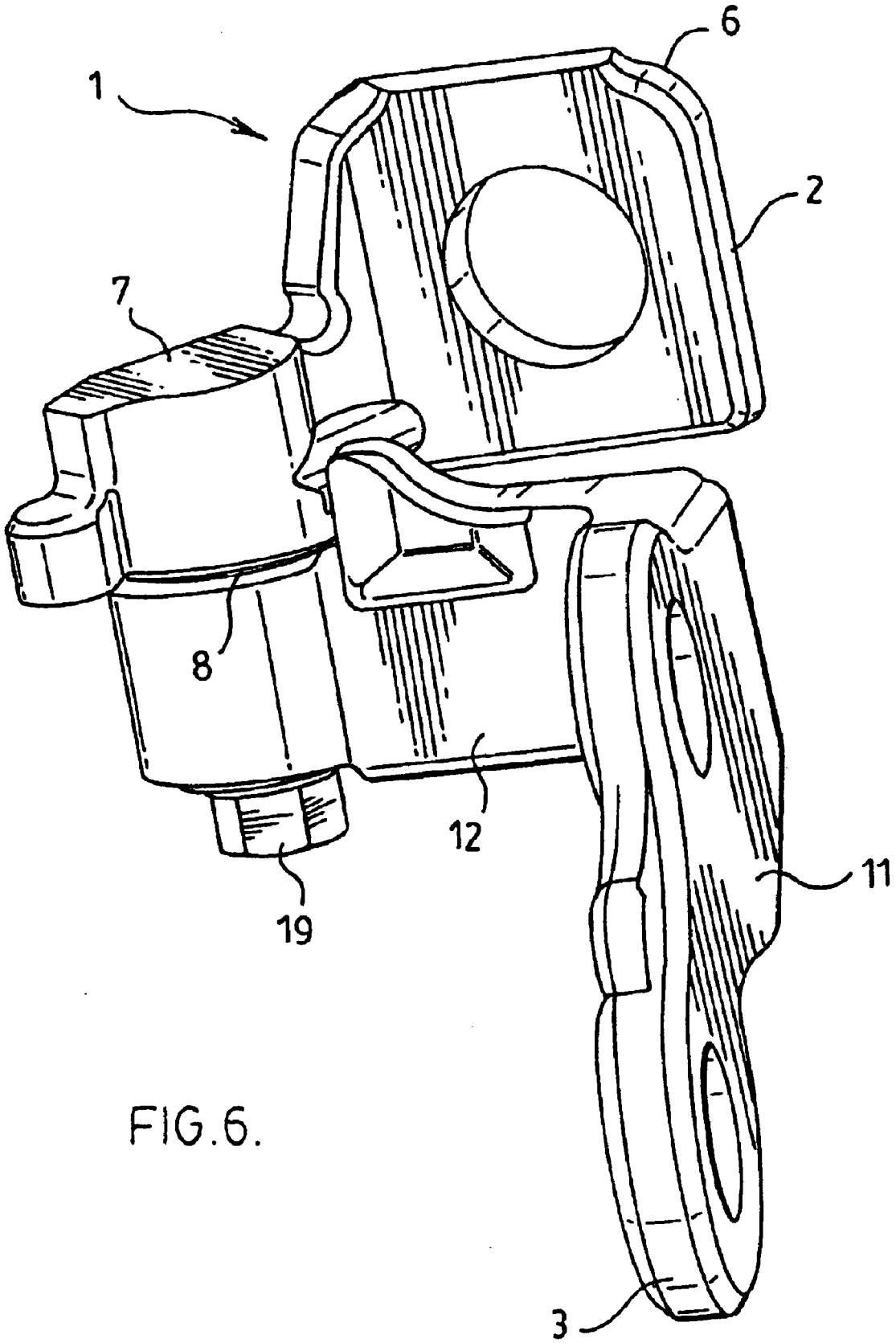
FIG. 6 is a perspective view of an alternative orientation of the inventive hinge assembly in a fully assembled state.
Figure 7:
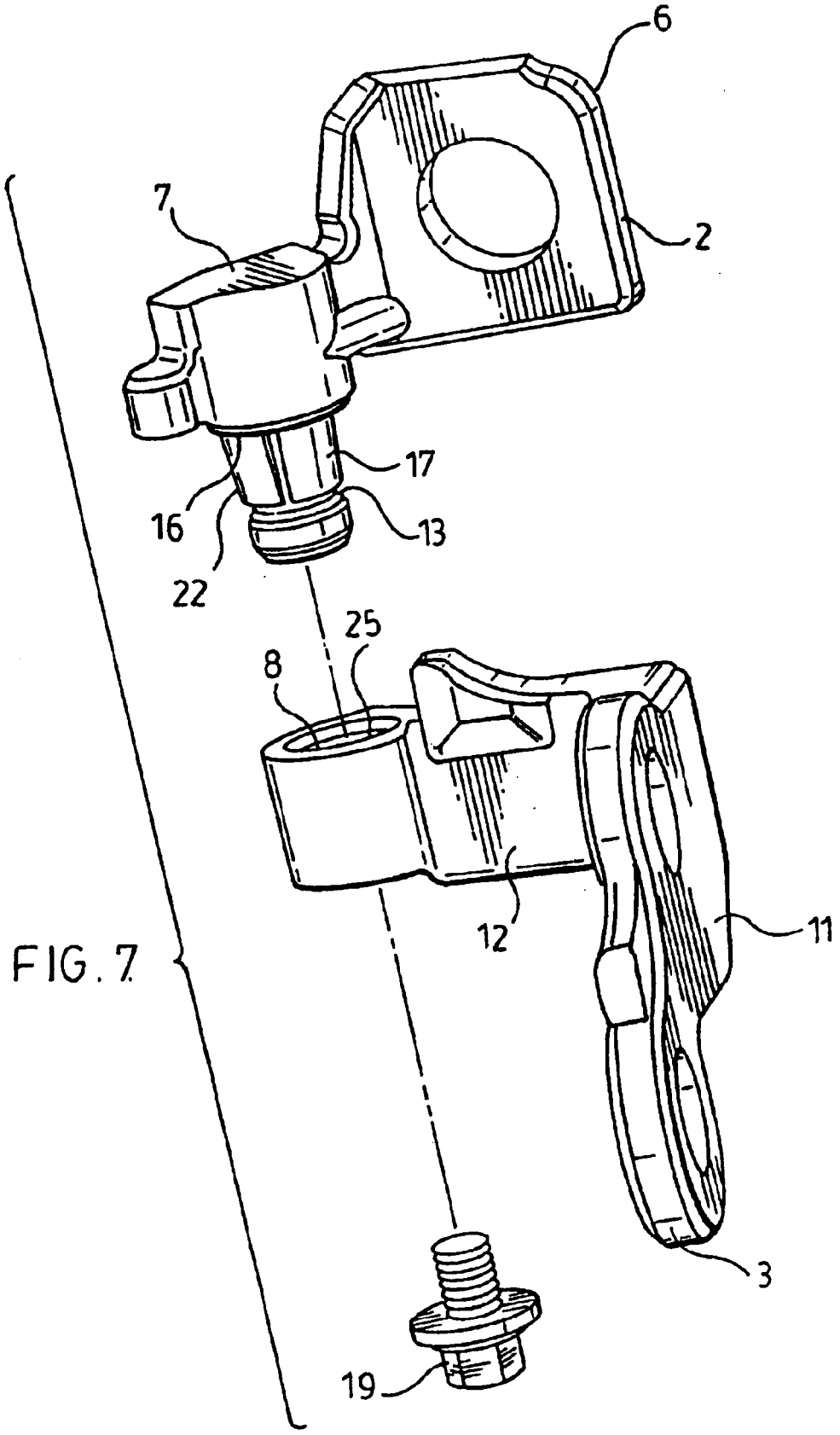
FIG. 7 is an exploded perspective view of the components of the alternative orientation of the inventive hinge assembly of FIG. 6.

It will be readily apparent that the locations of the conical structural feature and the conical pivot axis aperture can be switched. In this alternative embodiment, the conical structural feature is directed downwardly into a conical pivot axis aperture. Referring to FIGS. 6 and 7 only, a door hinge assembly (1) is substantially constructed from a body component (3) and a door component (2). The body component is configured with a mounting surface (11) and a pivot arm (12). The body component pivot arm (12) contains a conical pivot axis aperture (8). The door component (2) is configured with a mounting surface (6) and a pivot arm (7). The door component (2) is structurally attached to a closure panel via the door component's mounting surface (6) using bolting, welding, bonding, riveting or similar fastening means. The door component pivot arm (7) is configured with a conical structural feature (13) which contains an internally threaded feature coaxial with its outer surface. The body component (3) is structurally attached to a body structure via its body component mounting surface (11) using bolting, welding, bonding, riveting or similar fastening means.

A rigid bushing (17) is internally coated with a lubricating film such as the polymer PTFE and is configured to fit over the conical structural feature (13) and provide a horizontal load bearing surface (16) against the door component's pivot arm (7) and an internal tapered surface configured to bear against the conical structural feature. Other lubricating films or coatings may also be employed to permit the internally facing tapered surface of the bushing to rotationally slide over the outer bearing surface of the conical structural feature. The rigid bushing functions as in the previous embodiment.

Still referring to FIGS. 6 and 7 only, the door component (2) interleaves over the body component (3) and dimensionally locates itself by means of the external, unlubricated tapered surface (22) of the rigid bushing (17) mating to the walls (25) of the conical pivot axis aperture (8) of the body component (3). The assembly is structurally completed as previously described.

The removal of the closure panel following a painting operation may be performed in the same way as with the previously described embodiment, in that the closure panel is lifted from the vehicle body and reinstalled in analogous fashion.

Figure 8:
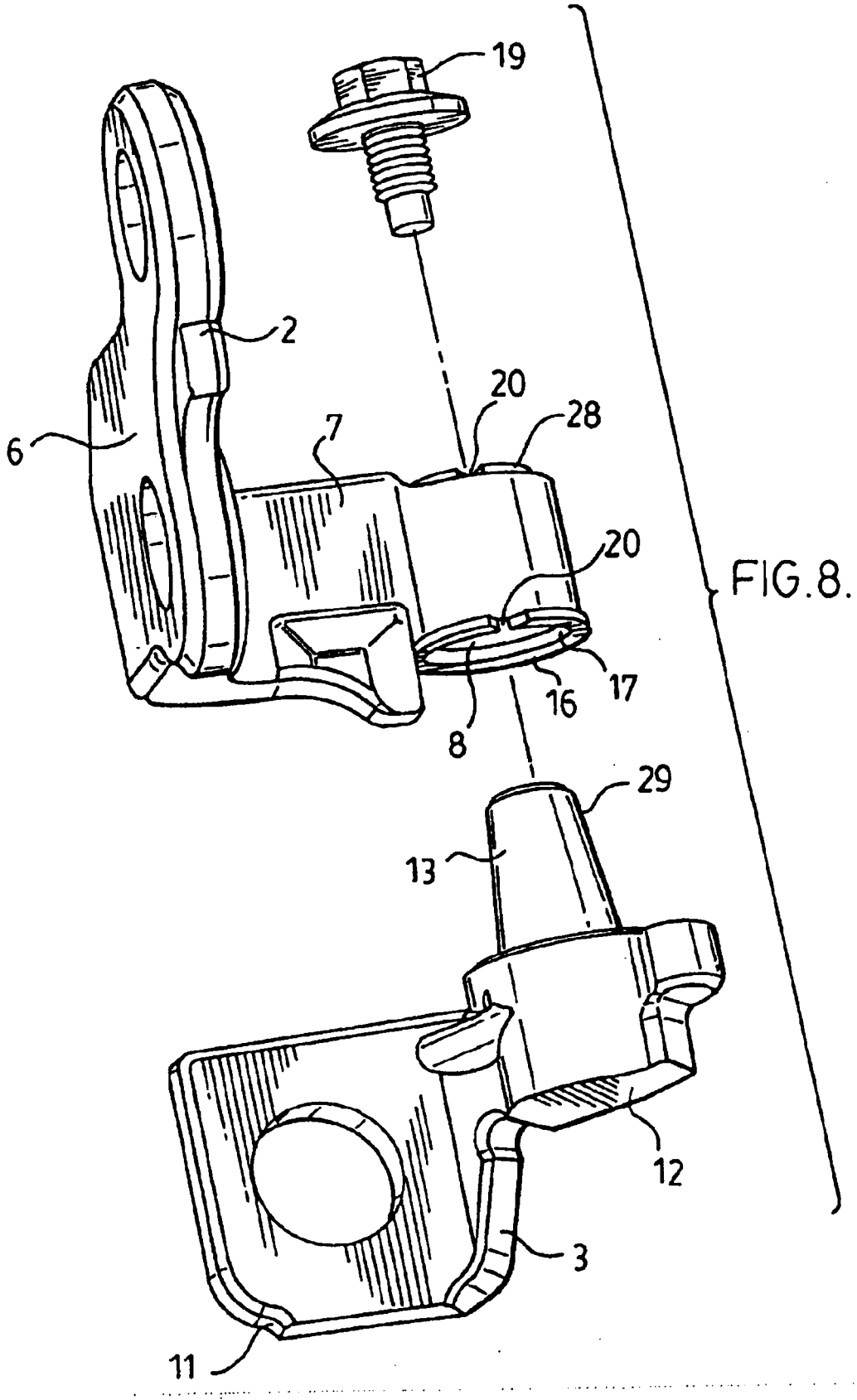
FIG. 8 is an exploded perspective view of the components of an alternative bushing configuration of the inventive hinge assembly.
Figure 9:
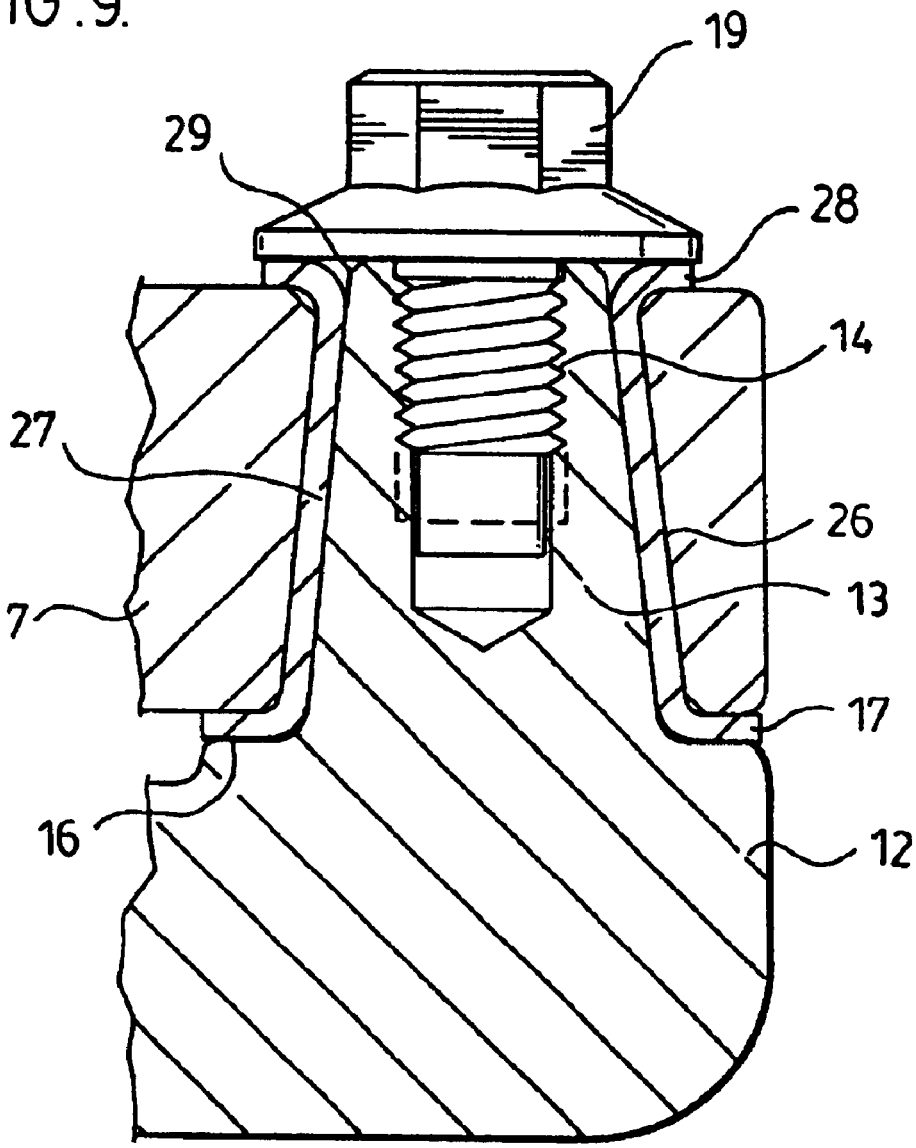
FIG. 9 is a partial sectional view of an alternative bushing configuration of the inventive hinge assembly through the centreline of the conical, structural feature.

Referring to FIGS. 8 and 9, it will be readily apparent that the location of the rigid bushing (17) can be interchanged from fitting over the conical structural feature (13) to fitting inside the conical pivot axis aperture (8). In this alternative embodiment, the rigid bushing (17) is externally coated with a lubricating film such as the polymer PTFE, and is configured to fit into the conical pivot axis aperture (8) and provide a horizontal load bearing surface (16) against the hinge body component's pivot arm (12) and an externally tapered surface (26) configured to bear against the internal conical bearing surface of the conical pivot axis aperture (8). Other lubricating films or coatings may also be employed to permit the externally facing tapered surface of the bushing to rotatingly slide over the internal conical bearing surface of the conical pivot axis aperture. A split line (20) allows the bushing to be easily installed since it can close and contract to be fitted into the conical pivot axis aperture, and aids in rotationally locking the bushing onto the conical structural feature (13) on the internal, unlubricated tapered surface (27) of the bushing when longitudinal or vertical retention force is applied. The bushing material is upset upon installation to create a retention flange (28) over the door component pivot arm (7) at the opposing end to the horizontal load bearing surface (16) so that the rigid bushing is positively retained in the door component pivot arm (7).

The door component (2) interleaves over the body component (3) and dimensionally locates itself by means of the internal, unlubricated tapered surface (27) of the rigid bushing (17) mating to the outer surface (29) of the conical structural feature (13) of the body component (3). The assembly is structurally completed as previously described.

Relative rotation of the two hinge components is facilitated by the rigid bushing (17) remaining free to rotate against the internal conical bearing surface of the conical pivot axis aperture (8). The rigid bushing (17) is in turn rotationally locked to the conical structural feature (13) of the body component (3) by frictional contact between the unlubricated tapered surface (27) of the rigid bushing (17) and the outer surface (29) of the conical structural feature (13).

The removal of the closure panel following a painting operation may be performed in the same way as with the previously described embodiments, in that the closure panel is lifted from the vehicle body and reinstalled in analogous fashion. The only change is the location of the bushing.

It will be readily apparent that this alternative rigid bushing configuration can be used in either of the alternative hinge configurations described above, in which the locations of the conical structural feature and the conical pivot axis aperture are switched.

Although, a preferred embodiment of the invention has been illustrated, it will be apparent to the skilled workman that variations or modifications of the illustrated structure may be made without departing from the spirit or scope of the invention.

What is claimed is:

1. An automotive hinge comprising:

(a) a door component adapted to be mounted to a vehicular closure panel, said door component comprising a conical pivot axis aperture;

(b) a body component adapted to be mounted to a vehicular body structure said body component comprising a pivot arm;

(c) the door component and the body component being adapted to rotate about a pivot axis;

(d) the body component comprising an upstanding, conical structural feature, wrought from the base material of the body component extending from the body component and adapted to be coaxially aligned with the pivot axis and structurally fixed to the pivot arm of the body component;

(e) said conical structural feature comprising an external conical bearing surface;

(f) a rigid bushing configured to fit over the conical structural feature;

(g) said rigid bushing comprising an internally facing surface comprising a lubricating coating or film adapted to contact said conical bearing surface of the conical structural feature;

(h) said rigid bushing further comprising a split line and an unlubricated externally facing surface to facilitate clamping of said bushing into the conical pivot axis aperture;

(i) said rigid bushing further comprising a base comprising a horizontal surface configured substantially perpendicular to a longitudinal axis of said bushing, said horizontal surface being adapted to carry vertical hinge loadings;

such that when the hinge is assembled, the door component interleaves over the body component, dimensionally locating said door and body components by means of the walls of the conical pivot axis aperture of the door component interacting with the external conical bearing surface through the interposed rigid bushing.

2. The automotive hinge of claim 1, wherein the conical structural feature is machined, forged or cast in the base material of the hinge body component.

3. The automotive hinge of claim 1, wherein the conical, structural feature comprises a distal end and further comprises an outward step proximate said distal end, said step being configured to retain the rigid bushing.

4. The automotive hinge of claim 1, wherein the body component and the door component are retained in assembly by a bolt configured to thread coaxially into an internally threaded feature in the conical structural feature.

5. The automotive hinge of claim 1, wherein the body component and the door component are retained in assembly by a clip, nut or other similar mechanical fastening means.

6. The automotive hinge of claim 1, wherein said lubricating coating or film comprises PTFE.

7. An automotive hinge comprising:

(a) a body component adapted to be mounted to a vehicular body structure, said body component comprising a conical pivot axis aperture;

(b) a door component adapted to be mounted to a vehicular closure panel, said door component comprising a pivot arm;

(c) the body component and the door component being adapted to rotate about a pivot axis;

(d) the door component comprising a conical structural feature, wrought from the base material of the door component, extending from the door component, and adapted to be coaxially aligned with the pivot axis and structurally fixed to the pivot arm of the door component;

(e) said conical structural feature comprising an external conical bearing surface;

(f) a rigid bushing configured to fit over the conical structural feature;

(g) said rigid bushing comprising an internally facing tapered surface comprising a lubricating coating or film adapted to contact said conical bearing surface of the conical structural feature;

(h) said rigid bushing further comprising a split line and an unlubricated externally facing surface to facilitate clamping of said bushing into the conical pivot axis aperture;

(i) said rigid bushing further comprising a base comprising a horizontal surface configured substantially perpendicular to a longitudinal axis of said bushing, said horizontal surface being adapted to carry vertical hinge loadings;

such that when the hinge is assembled, the door component interleaves over the body component, dimensionally locating said body and door components by means of the walls of the conical pivot axis aperture of the body component interacting with the external conical bearing surface of the conical structural feature through the interposed rigid bushing.

8. The automotive hinge of claim 7, wherein the conical structural feature is machined, forged or cast in the base material of the hinge door component.

9. The automotive hinge of claim 7, wherein the conical structural feature comprises a distal end and further comprises an outward step proximate said distal end, said step being configured to retain the rigid bushing.

10. The automotive hinge of claim 7, wherein the door component and the body component are retained in assembly by a bolt configured to thread coaxially into an internally threaded feature in the conical structural feature.

11. The automotive hinge of claim 7, wherein the body component and the door component are retained in assembly by a clip, nut or other similar mechanical fastening means.

12. The automotive hinge of claim 7, wherein said lubricating coating or film comprises PTFE.

13. An automotive hinge comprising:

(a) a door component adapted to be mounted to a vehicular closure panel, said door component comprising a conical pivot axis aperture;

(b) a body component adapted to be mounted to a vehicular body structure said body component comprising a pivot arm;

(c) the door component and the body component being adapted to rotate about a pivot axis;

(d) the body component comprising an upstanding, conical structural feature, extending from the body component and adapted to be coaxially aligned with the pivot axis and structurally fixed to the pivot arm of the body component;

(e) said door component conical pivot axis aperture comprising an internal conical bearing surface;

(f) a rigid bushing configured to fit into the conical pivot axis aperture;

(g) said rigid bushing comprising an externally facing surface comprising a lubricating coating or film adapted to contact said internal conical bearing surface of the conical pivot axis aperture;

(h) said rigid bushing further comprising an unlubricated internally facing surface to facilitate clamping of said bushing onto the conical structural feature;

such that when the hinge is assembled, the door component interleaves over the body component, dimensionally locating said door and body components by means of the outer surface of the conical structural feature of the body component interacting with the internal conical bearing surface through the interposed rigid bushing.

14. The automotive hinge of claim 13, wherein the conical structural feature is wrought from the base material of the body component.

15. The automotive hinge of claim 13, wherein the conical structural feature is machined, forged or cast in the base material of the hinge body component.

16. The automotive hinge of claim 13, wherein the rigid bushing further comprises a split line to facilitate mounting of the bushing and clamping of the bushing onto the conical structural feature.

17. The automotive hinge of claim 13, wherein said rigid bushing further comprises a horizontal surface configured substantially perpendicular to a longitudinal axis of said bushing, said horizontal surface being adapted to carry vertical hinge loadings.

18. The automotive hinge of claim 13, wherein said lubricating coating or film comprises PTFE.

19. An automotive hinge comprising:

(a) a body component adapted to be mounted to a vehicular body structure, said body component comprising a conical pivot axis aperture;

(b) a door component adapted to be mounted to a vehicular closure panel, said door component comprising a pivot arm;

(c) the body component and the door component being adapted to rotate about a pivot axis;

(d) the door component comprising a conical structural feature extending from the door component and adapted to be coaxially aligned with the pivot axis and structurally fixed to the pivot arm of the door component;

(e) the body component conical pivot axis aperture comprising an internal conical bearing surface;

(f) a rigid bushing configured to fit into the conical pivot axis aperture;

(g) said rigid bushing comprising an externally facing surface comprising a lubricating coating or film adapted to contact said internal conical bearing surface of the conical pivot axis aperture;

(h) said rigid bushing further comprising an unlubricated internally facing surface to facilitate clamping of said bushing onto the conical structural feature;

such that when the hinge is assembled, the door component interleaves over the body component, dimensionally locating said door and body components by means of the outer surface of the conical structural feature of the door component interacting with the internal conical bearing surface through the interposed rigid bushing.

20. The automotive hinge of claim 19, wherein the conical structural feature is wrought from the base material of the door component.

21. The automotive hinge of claim 19, wherein the conical structural feature is machined, forged or cast in the base material of the door component.

22. The automotive hinge of claim 19, wherein the rigid bushing further comprises a split line to facilitate mounting of the bushing and clamping of the bushing onto the conical structural feature.

23. The automotive hinge of claim 19, said rigid bushing further comprises a horizontal surface configured substantially perpendicular to a longitudinal axis of said bushing, said horizontal surface being adapted to carry vertical hinge loadings.

24. The automotive hinge of claim 13, wherein the body component and door component are retained in assembly by a clip, nut or other similar mechanical fastening means.

25. The automotive hinge of claim 19, wherein the body component and door component are retained in assembly by a clip, nut or other similar mechanical fastening means.

26. The automotive hinge of claim 19, wherein said lubricating coating or film comprises PTFE.

* * * * *